US006219889B1

(12) United States Patent
Lovato et al.

(10) Patent No.: US 6,219,889 B1
(45) Date of Patent: Apr. 24, 2001

(54) ADJUSTABLE CLASP DEVICE

(75) Inventors: Attilio Lovato, Pino Torinese; Filippo Perini, Bobbio, both of (IT)

(73) Assignees: National Molding of Europe S.r.L., Turin; MET S.p.A., Sondrio, both of (IT)

( * ) Notice: Subject to any disclaimer, the term of this patent is extended or adjusted under 35 U.S.C. 154(b) by 0 days.

(21) Appl. No.: 09/393,331

(22) Filed: Sep. 10, 1999

(30) Foreign Application Priority Data

Jun. 9, 1999 (IT) ..... TO99A0496

(51) Int. Cl.[7] ..... A44B 11/25

(52) U.S. Cl. ..... 24/585; 24/170; 24/615; 24/625; 24/634

(58) Field of Search ..... 24/585, 170, 615, 24/625, 634

(56) References Cited

U.S. PATENT DOCUMENTS 4,727,630 * 3/1988 Alan ..... 24/585
5,161,351 * 11/1992 Woodruff ..... 24/170
5,469,583 * 11/1995 Akeley et al. ..... 24/170
5,579,563 * 12/1996 Sim ..... 24/585
5,752,298 * 5/1998 Howell ..... 24/585

* cited by examiner

*Primary Examiner*—Victor N. Sakran
(74) *Attorney, Agent, or Firm*—Sughrue, Mion, Zinn, Macpeak & Seas, PLLC

(57) ABSTRACT

An adjustable clasp comprises a retainer body having an elongate cavity within which slides a strap having saw teeth. The retainer body includes a main generally non-deformable body from which extends a flexible tongue provided with pawls projecting into the cavity to engage the teeth of the strap, and at least one resilient wing facing the flexible tongue and engagable under pressure to disengage the pawls from the teeth of the strap. The retainer body has guide members on the main portion and second guide members close to the opposite end of the main body, to maintain the strap close to the pawls. The second guide members include a contact portion extending from the resilient wing at its end opposite the main portion of the retainer body.

10 Claims, 4 Drawing Sheets

ADJUSTABLE CLASP DEVICE

DESCRIPTION

The present invention relates to an adjustable clasp device comprising a retainer body provided with an elongate cavity for sliding of a strap having saw teeth, in which the retainer body and the strap are intended to be connected with associated elements to be joined together, the retainer body including a generally non-deformable main portion from which extends a flexible tongue provided with pawl means projecting into the said cavity and engageable with the teeth of the strap to prevent relative sliding of the retainer body and the strap, and at least one resilient wing arranged alongside the flexible tongue and operable under pressure to disengage the pawl means from the teeth of the strap, the retainer body having first guide members at the said main portion and second guide members in proximity with the end of the retainer body opposite its main portion, such guide members being intended to maintain the strap in a position in which its teeth are close to the pawl means.

In adjustable clasp devices of the known type defined above, the retainer body has a rigid structure with an intermediate part from which the said flexible tongue with the pawl means projects, and a pair of resilient wings. The rigid structure includes at both axial ends, that is on opposite parts with respect to the intermediate part with the flexible tongue and the resilient wings, guide members which surround the strap to retain it in a position close to the pawl means of the flexible tongue.

Because of the structure of the retainer body, in particular due to the presence of rigid guide means at both axial ends of the body, known adjustable clasp devices are relatively long in the axial direction of the strap such that they are not well adapted to be used in applications in which a compact form of the retainer body is required.

For the purpose of overcoming this disadvantage, the subject of the present invention is a clasp device of the type indicated above, characterised in that the second guide members comprise an abutment portion which extends from the said at least one resilient wing at its end substantially opposite the main portion of the retainer body.

Thanks to this arrangement the retainer body of the clasp device according to the invention can be formed with a non-deformable main portion of limited axial extent, from which a plurality of flexible elements project which also define the second guide means for the strap, such that the clasp device can be formed in such a way as to be significantly more compact than known similar devices.

The invention also comprehends a headband for headgear such as a helmet, characterised in that it includes a tension adjustment fitting including at least one adjustable clasp device of the above-indicated type.

Further characteristics and advantages of the invention will become more apparent from reading the following detailed description, provided purely by way of non-limitative example and with reference to the attached drawings, in which.

Figure 1:
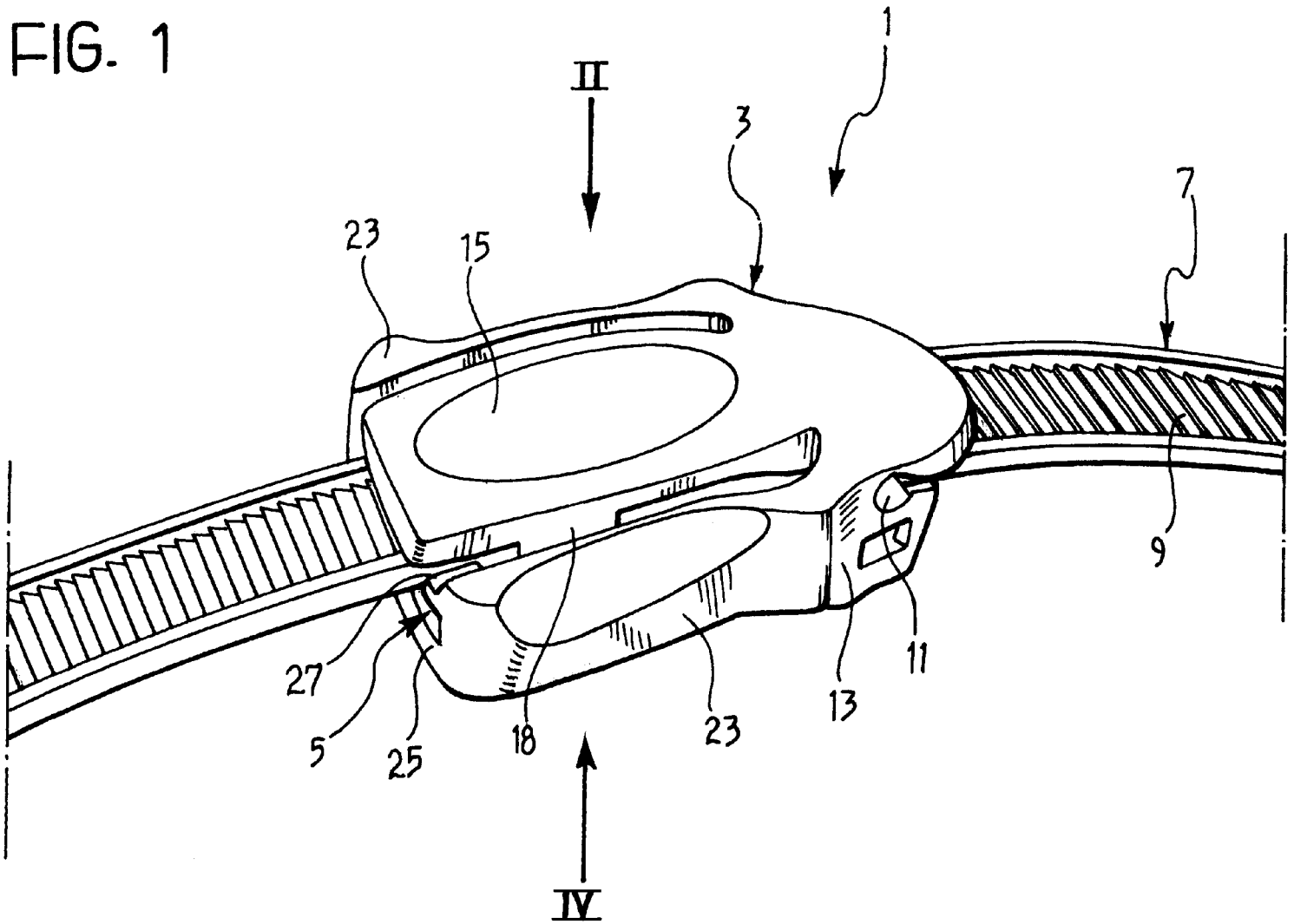
FIG. 1 is a schematic perspective view of an adjustable clasp device according to the invention.
Figure 2:
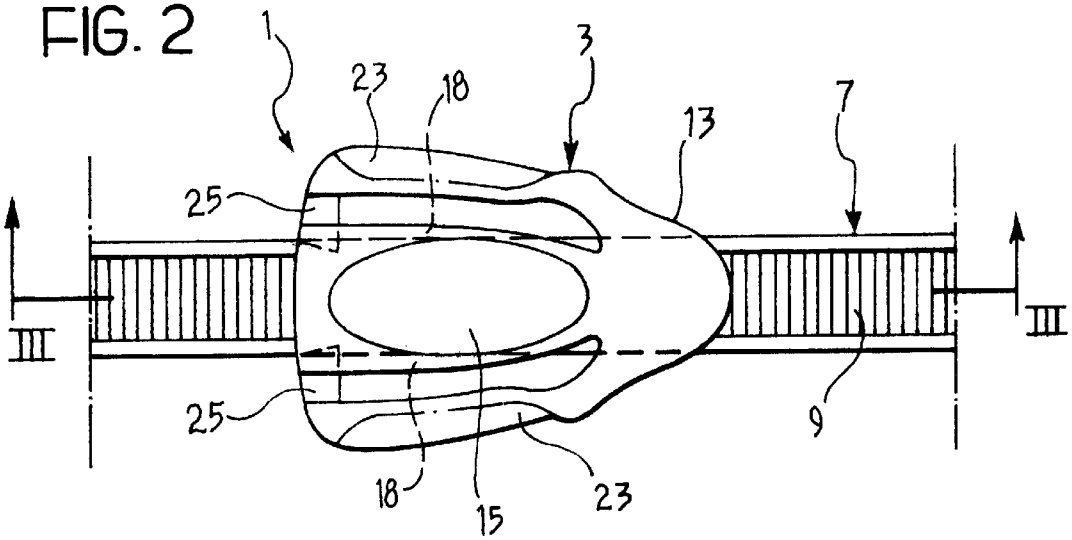
FIG. 2 is an elevational view seen in the direction of the arrow II of FIG. 1.
Figure 3:
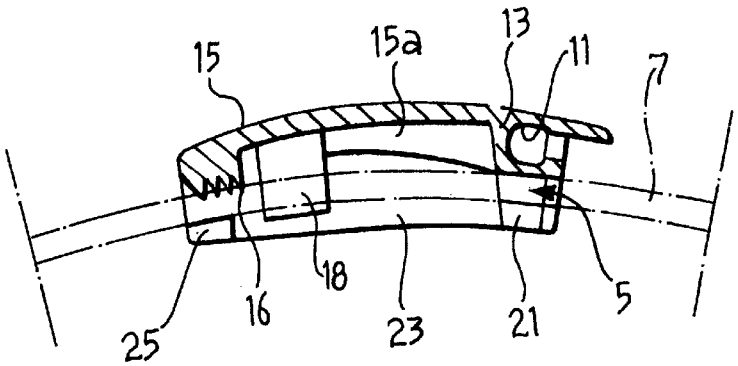
FIG. 3 is a sectioned elevational view taken on the line III—III of FIG. 2.
Figure 4:
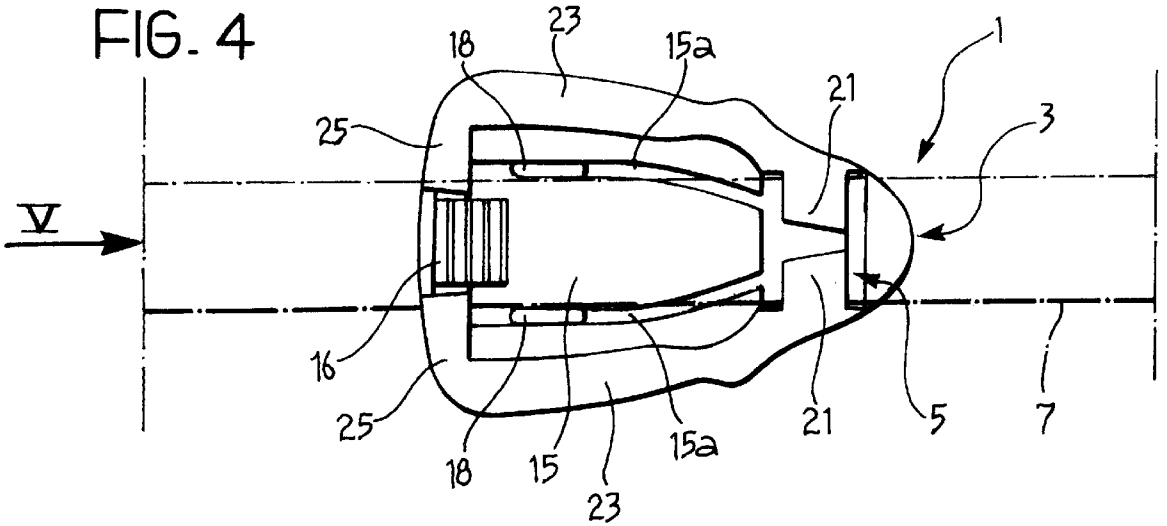
FIG. 4 is an elevational view seen in the direction of the arrow IV of FIG. 1, in which the strap is indicated in broken outline.
Figure 5:
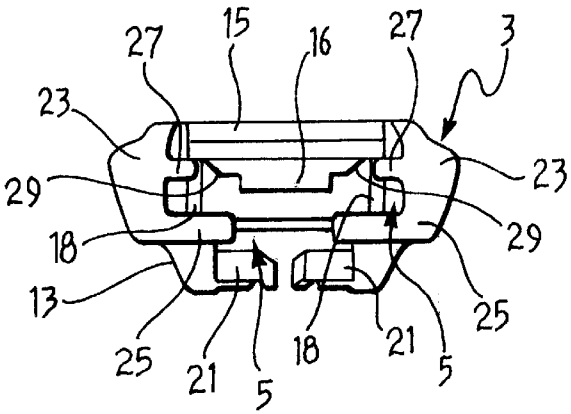
FIG. 5 is a front elevational view seen from the direction of the arrow V of FIG. 4.

First, with reference to FIGS. 1 to 5, an adjustable clasp device is generally indicated with reference numeral 1. An adjustment device of this type can be used, for example, for clasping any type of strap or a closure edge of a garment, for example a footwear.

The device 1 comprises a retainer body 3, normally made in one piece of moulded plastics material, preferably of a plastics material including a mineral filler such as glass fibre to make it sufficiently rigid.

The body 3 has an elongate longitudinal cavity 5 in which a strap 7 is slidably arranged, which is also normally made of plastics material, on one side of which are formed a series of saw teeth 9. The body 3 and the strap 7 are intended to be connected each with an associated element to be joined together (not illustrated in the drawings). For this purpose, in the body 3 there is provided a cylindrical seat 11 transversely of the axis of the strap 7 for engagement of the end of such an element, for example in the form of a strip, having a corresponding cylindrical terminal portion.

The body 3 is provided with a substantially non-deformable main portion 13, also traversed by the cavity 5. From the portion 13 extends a tongue 15 at least of limited flexibility and provided, on the opposite end from the portion 13, with a plurality of teeth 16 serving as pawls for engagement of the teeth 9 of the strap 7. Preferably there are four teeth 16. Conveniently, the tongue 15 is provided on its inner surface facing towards the strap 7 with perimetral reinforcing ribs 15*a*.

From the tongue 15 extend, on the same side as the teeth 16, a pair of blade-like projections 18 arranged parallel to one another and to the axis of the strap 7 and separated by a distance equal to the width of the strap 7, for the purpose of constituting a containment guide for the relative axial movement of the strap with respect to the body 3 and to maintain the strap 7 in a position in which its teeth 9 face the teeth 16 so as to encourage correct engagement of these teeth with one another.

The part of the cavity 5 formed in the main portion 13 is delimited on the opposite side from the tongue 15 by a pair of brackets 21 which extend from the portion 13, between which brackets is defined a V-shape space the vertex of which faces away from the tongue 15, the purpose of which will be explained hereinafter.

From the portion 13, alongside the tongue 15, also project a pair of resilient wings 23 preferably having a form tapered towards the end opposite the main portion 13, that is in correspondence with their flexing region, in such a way as substantially to prevent them from being able to be subject to appreciable torsional deformations with respect to the main portion 13.

At the end of each wing 23 opposite the portion 13 a blade-like abutment portion 25 projects towards the general axis of the strap 9 in such a way as to lie against at least the side of the strap 7 opposite the tongue 15, to retain the strap 7 close to the teeth 16 of the tongue 15.

From the end of each of the wings 23 there also extends a counter element 27, substantially parallel to the associated portion 25, and shorter than it, intended to interfere by means of its free end with an inclined lateral surface 29 formed alongside the teeth 16 in such a way that, following a pressure exerted from the outside onto the wings 23 and their consequent deformation towards the tongue 15, the counter elements 27 cause separation of the tongue 15, and therefore of its teeth 16, from the position of engagement with the teeth 9 of the strap 7.

Thanks to the structure of the body 3 according to the invention, which in particular has a relatively small main portion 13 from which extend only cantilevered parts, in particular the tongue 15 and the two wings 23, the body 3 is very compact and can be made with the use of less material whilst still being able to ensure an extremely effective grip on the teeth 9 of the strap 7.

Figure 6:
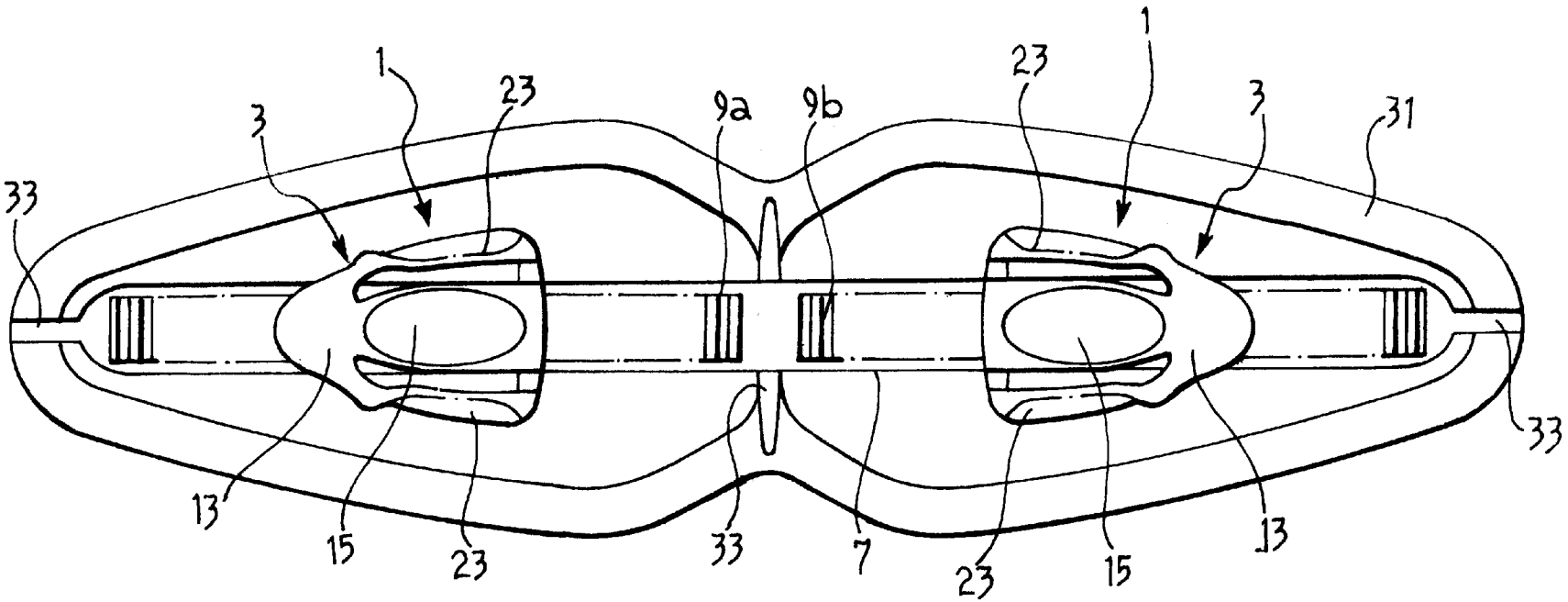
FIG. 6 is a schematic upper elevational view of an adjustment fitting usable in a headband for headgear.

With reference to FIG. 6, a pair of clasp devices 1 can be used in a headband for headgear such as a helmet. In this case, the headband (not illustrated entirely in the figures in that its general structure is known per se) has its opposite ends each connected to a respective retainer body 3 by the insertion of an associated cylindrical end piece into a corresponding seat 11.

The retainer bodies 3 are mounted in opposite positions from one another in such a way as both to be slidable along a common strap 7 of arcuate form connected by means of bridges 33 to a shaped structure 31 in such a way as to be able to rest on the occipital region of the head.

In particular, the strap 7 has a first series of teeth 9*a* and a second series of teeth 9*b*, both of sawtooth type, with opposite inclinations in such a way that by bringing the retainer bodies 13 towards one another it is possible to tension the headband by causing relative approach of both its ends, whilst when they are separated from one another the headband become enlarged.

The bridges 33 arranged close to the axial ends of the structure 31 have a strut part joined to the face of the straps 7 opposite that which carries the teeth 9*a*, 9*b*. The V-shape space of each body 3 has a width slightly less than the width of this strut part so that when the body 3 is fitted onto the associated part of the strap 7 the brackets 21 deform slightly, thanks to their entrance region constituted by the V-shape, thus allowing the strut part to be formed into the V-shape space, but opposing the passage of the strut part when the body 3 moves along the strap 7 in the opposite direction, thereby preventing accidental separation of each of the bodies 3 from the strap 7.

What is claimed is:

1. An adjustable clasp device comprising a retainer body provided with an elongate cavity for sliding of a strap having saw teeth, in which the retainer body and the strap are intended to be connected with associated elements to be joined together, the retainer body including a generally non-deformable main portion from which extends a flexible tongue provided with pawl means projecting into the said cavity and engageable with the teeth of the strap to prevent relative sliding of the retainer body and the strap, and at least one resilient wing arranged alongside the flexible tongue and operable under pressure to disengage the pawl means from the teeth of the strap, the retainer body having first guide members at the said main portion and second guide members in proximity with the end of the retainer body opposite its main portion, such guide members being intended to maintain the strap in a position in which its teeth are close to the pawl means, wherein the second guide members comprise an abutment portion which extends from the said at least one resilient wing at its end substantially opposite the main portion of the retainer body.

2. A device according to claim 1, wherein the second guide members include lateral containment means for the strap which comprise at least one projection extending from the flexible tongue on the same side as the pawl means, to maintain the teeth of the strap in a position facing the pawl means.

3. A device according to claim 2, wherein the retainer body includes a pair of resilient wings arranged symmetrically with respect to the flexible tongue, the flexible tongue having a pair of lateral containment projections for the strap each arranged in correspondence with a resilient wing and separated from one another by a distance substantially equal to the width of the strap.

4. A device according to claim 1, wherein each resilient wing is formed in such a way as substantially to resist torsional deformations of the wing with respect to the main portion of the retainer body.

5. A device according to claim 4, wherein each resilient wing has a substantially tapered form tapering towards the end thereof opposite the main portion of the retainer body.

6. A device according to claim 1, wherein close to the pawl means there is formed at least one laterally inclined surface capable of being engaged, when the said at least one resilient wing is subjected to a pressure, by an associated counter element which extends from an associated resilient wing, whereby to separate the pawl means from the teeth of the strap.

7. A device according to claim 1, wherein the retainer body is formed in one piece of molded plastics material.

8. A device according to claim 7, wherein the plastics material of the retainer body incorporates a mineral filler, preferably glass fibre.

9. An adjustable headband for headgear such as a helmet, wherein it includes a tension adjustment fitting including at least one adjustable clasp device according to claim 1.

10. An adjustable headband according to claim 9, wherein its opposite ends are each connected to a respective retainer body, such retainer bodies being mounted opposite one another and both slidable along a common strap fixed to a structure for resting on the occipital region of the head, the straps having a first series of sawteeth for engagement by one of the said retainer bodies and a second series of saw teeth having an opposite inclination with respect to the teeth of the said first series, for engagement by the other retainer body.

* * * * *